United States Patent [19]

Yoshikawa et al.

[11] Patent Number: 5,009,038

[45] Date of Patent: Apr. 23, 1991

[54] AUTOMATIC CHAMFERING MACHINE

[75] Inventors: Akira Yoshikawa, Nagoya; Setsuo Torikai, Konan, both of Japan

[73] Assignee: NKG Insulators, Ltd., Nagoya, Japan

[21] Appl. No.: 552,836

[22] Filed: Jul. 16, 1990

Related U.S. Application Data

[63] Continuation of Ser. No. 318,420, Feb. 28, 1989, abandoned, which is a continuation of Ser. No. 88,519, Aug. 20, 1987, abandoned, which is a continuation of Ser. No. 837,262, Mar. 7, 1986, abandoned.

[30] Foreign Application Priority Data

Mar. 20, 1985 [JP] Japan ..... 60-54169

[51] Int. Cl.[5] ..... B24B 9/00

[52] U.S. Cl. ..... 51/126; 51/99; 51/101 R; 51/127; 51/237 T

[58] Field of Search ..... 51/50 PC, 97 NC, 101 R, 51/101 LG, 105 EC, 105 LG, 108 R, 124 R, 124 L, 126, 127, 129, 132, 134, 237 T, 283 E, 284 E, 99

[56] References Cited

U.S. PATENT DOCUMENTS

| | | | |
|---|---|---|---|
| 1,477,758 | 12/1923 | Johnson | 51/108 R X |
| 1,905,190 | 4/1933 | Silvester . | |
| 2,248,143 | 7/1941 | Weber | 51/101 R |
| 2,741,072 | 4/1956 | Pruitt . | |
| 2,874,616 | 2/1959 | Cardinal . | |
| 3,187,467 | 6/1965 | Cortesi | 51/34 D |
| 3,274,736 | 9/1966 | Brokaw | 51/101 R X |
| 3,289,717 | 12/1966 | Dutot . | |
| 3,435,563 | 4/1969 | Reaser | 51/101 R |
| 3,513,598 | 5/1970 | Asselin et al. | 51/101 LG |
| 3,857,205 | 12/1974 | Van Hove | 51/134 |
| 3,977,131 | 8/1976 | Searle et al. | 51/108 R X |
| 4,081,927 | 4/1978 | Kelly | 51/101 R |
| 4,478,007 | 10/1984 | Bavelloni | 51/101 R X |
| 4,519,167 | 5/1985 | Halberschmidt | 51/283 E X |

FOREIGN PATENT DOCUMENTS

| | | |
|---|---|---|
| 4439909 | 1/1942 | Belgium . |
| 409385 | 2/1925 | Fed. Rep. of Germany . |
| 1415542 | 9/1965 | France . |
| 2000700 | 6/1979 | United Kingdom . |

*Primary Examiner*—Maurina Rachuba

*Attorney, Agent, or Firm*—Parkhurst, Wendel & Rossi

[57] ABSTRACT

An automatic chamfering machine for ceramic honeycomb structural bodies and the like workpieces is disclosed, and includes a clamping device by which a workpiece is clamped and caused to rotate in one direction. The movement of a grinder wheel with respect to the workpiece is controlled by a tracer element urged against the other peripheral surface of the workpiece itself, so as to carry out an autoprofiling chamfering operation. The grinder wheel thus removes a constant amount of material from the workpiece even when the workpiece has an irregular outer contour, or is clamped inaccurately.

2 Claims, 4 Drawing Sheets

AUTOMATIC CHAMFERING MACHINE

This is a continuation of application Ser. No. 318,420, filed Feb. 28, 1989, now abandoned, which is a Rule 62 continuation of application Ser. No. 088,519, filed Aug. 20, 1987, now abandoned, which is a Rule 62 continuation of application Ser. No. 837,262, filed Mar. 7, 1986, now abandoned.

BACKGROUND OF THE INVENTION

1. Field of the Invention

The present invention relates to an automatic chamfering machine wherein the movement of a grinder wheel with respect to a workpiece is controlled by a tracer element urged against the outer peripheral surface of the workpiece itself, to remove a constant amount of material and uniformly chamfer the outer periphery on one end surface of the workpiece.

2. Description of the Related Art

Generally, various articles are formed with chamfered end surfaces for inherent purposes. Referring to one example, a ceramic honeycomb structural body used as a catalytic converter in the exhaust gas system of an automobile is generally of cylindrical configuration having in its cross-section an elongated circular contour, with a number of parallel channels extending inside thereof between both end surfaces. Such a honeycomb structural body is thin-walled and liable to be broken, so that it is necessary to prevent damages arising from temperature variation, etc., of the structural body accommodated in a catalyzer casing to the extent possible. In this connection, there has been a proposal to chamfer the outer periphery on both end surfaces of the structural body by applying a grinding operation thereto and removing a constant amount of material, as disclosed, e.g. in U.S. Pat. No. 4,396,664.

Conventionally, however, the above-mentioned chamfering operation has been applied to the end surfaces of the honeycomb structural body manually by operating personnels. This results in a poor productivity and makes it difficult to maintain a constant product quality because of fluctuation in the amount of removed material.

One may thus consider that these drawbacks can be eliminated by making use of an automatic chamfering machine consisting of a profile grinding machine, which includes a tracer element adapted to be urged against the outer peripheral surface of a model to control the movement of a grinder wheel with respect to the workpiece. On the other hand, however, honeycomb structural bodies used as an automobile catalytic converter as mentioned above are often of different configuration and/or size, depending upon the type of vehicles. Thus, when realizing an automatic chamfering machine, the machine has to be adjusted to change models upon frequent alterations of the configuration or size of the product. Such an adjustment of the machine necessitates troublesome and time consuming manual operations, and makes it still difficult to improve the productivity.

SUMMARY OF THE INVENTION

Consequently, it is an object of the present invention to provide an automatic chamfering machine which can be operated with a significantly improved productivity, without requiring adjustment of the machine for various configuration or size of the product.

According to the present invention, there is provided a chamfering machine for workpieces having at least one end surface to be chamfered, comprising: a machine frame; a clamping device carried by the machine frame, for clamping each workpiece and rotating the clamped workpiece in one direction about an axis of rotation which extends substantially at right angle to said end surface; a chamfering grinder wheel supported by the machine frame so as to be movable in a direction substantially perpendicular to said axis of rotation, and adapted to be urged against the outer periphery on said end surface of the clamped workpiece; and a tracer element supported by the machine frame so as to be movable in a direction substantially perpendicular to said axis of rotation, and adapted to be urged against the outer peripheral surface of the clamped workpiece to trace the outer peripheral contour thereof; said grinder wheel and said tracer element being operatively associated with each other such that the tracer element while tracing the outer peripheral contour of the clamped workpiece controls the movement of the grinder wheel toward and away from said axis of rotation to carry out an autoprofiling chamfering operation with respect to said end surface following the outer peripheral contour of said workpiece.

With the above-mentioned arrangement of the present invention, the chamfering operation with respect to the outer periphery on the end surfaces of the workpiece is carried out by the autoprofiling operation of the grinder wheel, wherein the movement of the grinder wheel with respect to the workpiece is controlled by the tracer element urged against the outer peripheral contour of the workpiece itself. Thus, a constant amount of material can be removed from the outer periphery on the end surfaces of the workpiece.

The adjustment of the machine is not required even upon alterations of the configuration or size of the product, and the removal of a constant amount of material can be carried out with respect to workpieces of any configuration or size.

Moreover, the above-mentioned autoprofiling operation permits a constant amount of material to be removed even when the workpiece is not clamped at a constant location. Consequently, an accurate positioning is not required for clamping the workpiece, and the production cost of the machine can be reduced.

DESCRIPTION OF THE PREFERRED EMBODIMENT

Figure 1:
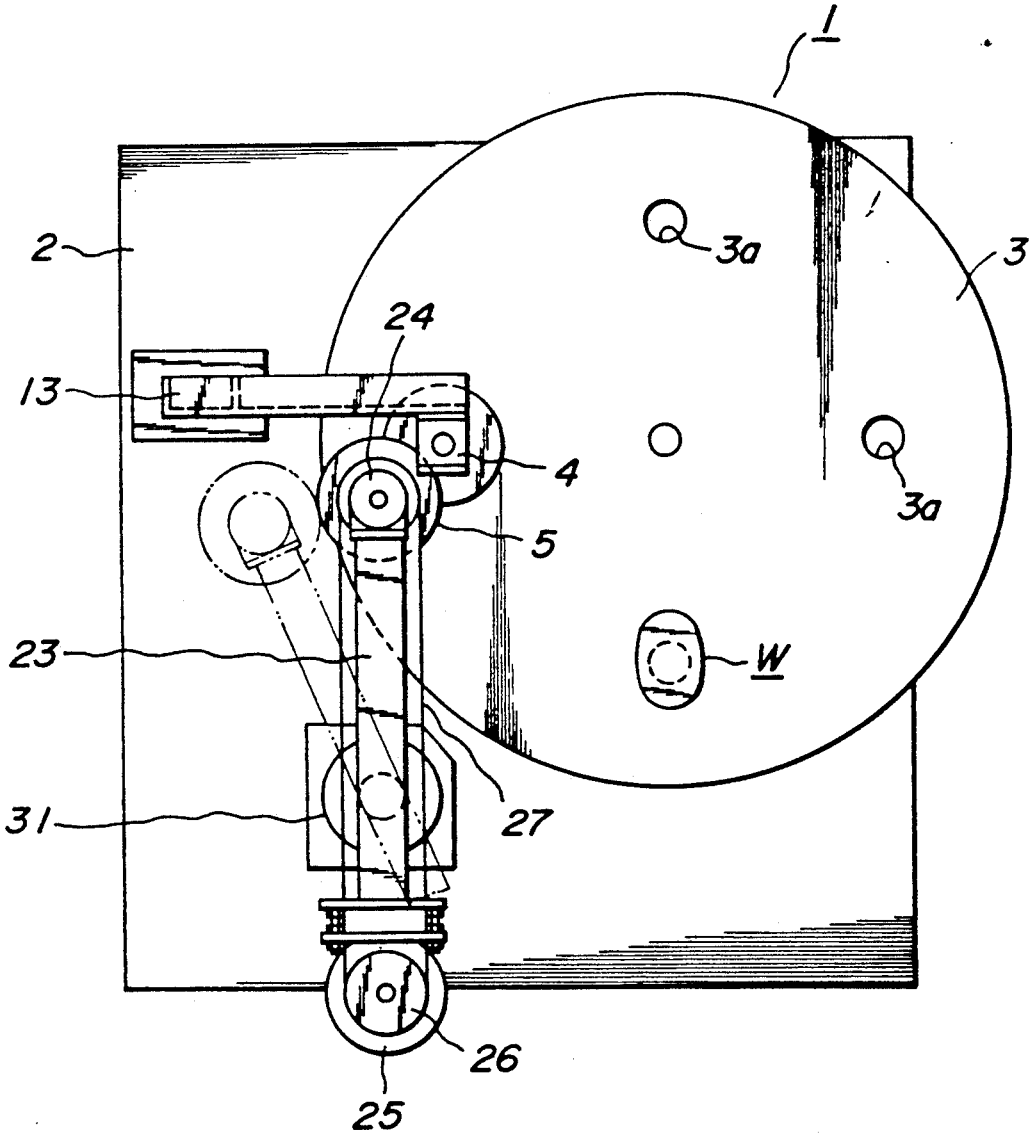
FIG. 1 is a plan view showing the automatic chamfering machine according to one embodiment of the present invention.

Referring now to the drawings, there is shown in FIGS. 1 to 5 a chamfering machine according to one embodiment of the present invention, which may suitably be used to carry out chamfering operation with respect to brittle workpieces, such as ceramic honeycomb structural bodies. The machine, designated generally by reference numeral 1, includes a machine frame 2 on which is rotatably supported a turntable 3 having a substantially vertical axis of rotation. The turntable 3 is provided with a substantially horizontal upper surface to support thereon a plurality of workpieces W. The turntable 3 is driven to successively feed the workpieces W to a location in which each workpiece can be clamped by, and released from a clamping device 4. Each workpiece W clamped by the clamping device 4 is chamfered by a grinder wheel 5 automatically, with a constant grinding depth. To this end, the movement of the grinder wheel 5 with respect to the workpiece W is controlled by a tracer element 6 which is adapted to be urged against the outer peripheral surface of the workpiece W itself. The arrangement of the above-mentioned elements will be explained hereinafter.

Figure 2:
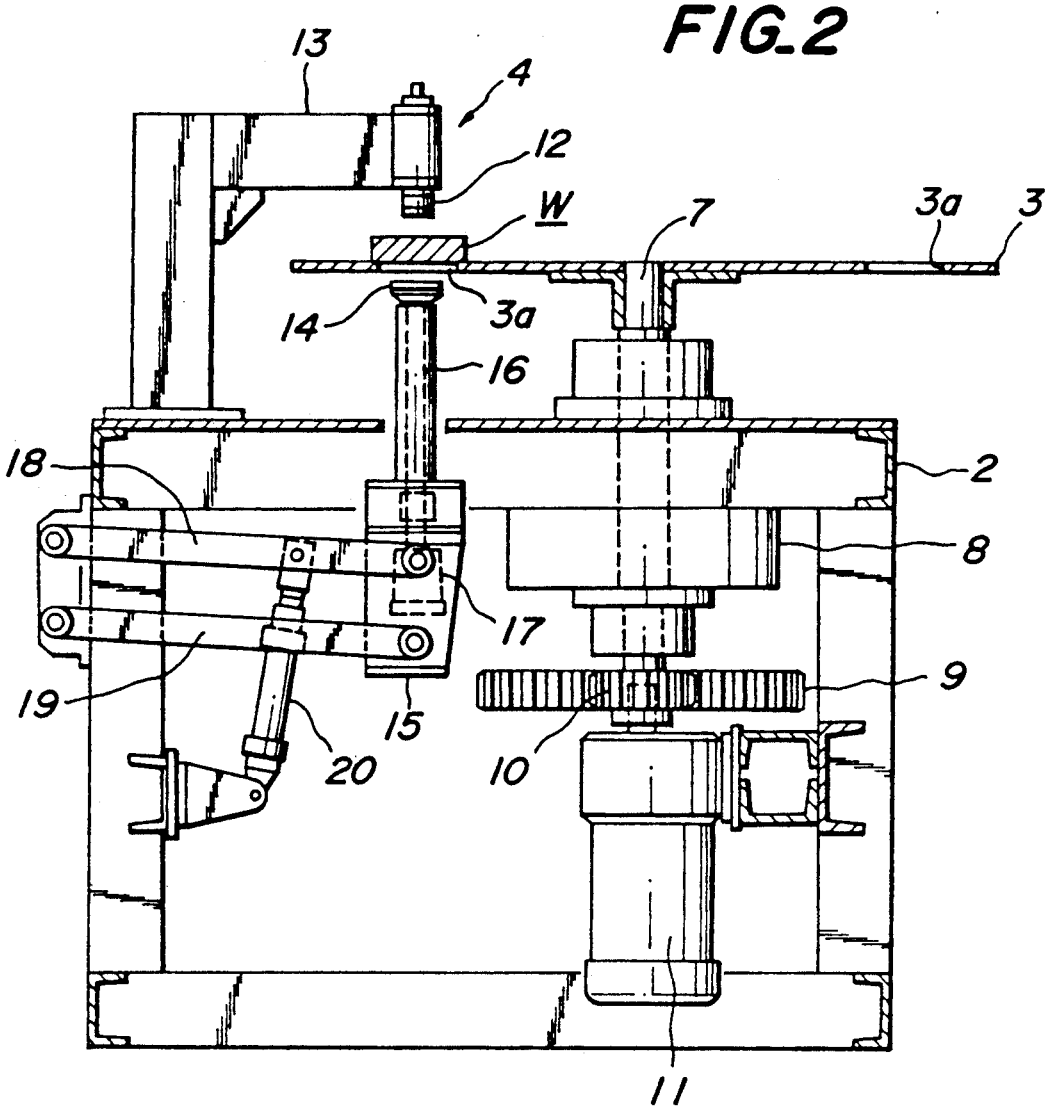
FIG. 2 is a side view, partly in section, showing the detail of the clamping device in the operative position thereof.

As shown in FIG. 1, the turntable 3 has a plurality of openings 3*a* formed therein, which are equiangularly arranged on the circumference of the turntable so that the workpieces W are supported on the periphery of the respective openings 3*a* and engaged with, or disengaged from the clamping device 4 in the manner to be described later. The turntable 3 is secured to a vertical shaft 7 rotatably journalled by a bearing 8 which, in turn, is secured to the machine frame 2 (FIG. 2). The shaft 7 has on its lower end a gear 9 secured thereto and meshed with an output gear 10 of a motor 11 for rotating the turntable. The drive of the motor 11 is effected so that the turntable 3 rotates intermittently at a predetermined interval to successively position the workpieces W at a location below the clamping device 4.

The clamping device 4 comprises, as shown in FIG. 2, an upper clamping disc 12 rotatably secured to the lower side of the free end of an arm 13 fixedly mounted on the frame 2, as well as a lower clamping disc 14 arranged in a vertically opposed relationship with the upper clamping disc 12 and rotatably secured to the upper end portion of a holder 15 arranged below the turntable 3. More particularly, the lower clamping disc 14 is secured to one end of a vertical shaft 16, which is adapted to be driven by a motor 17 accommodated in the holder 15, and is caused to rotate in a predetermined direction as the motor 17 is actuated. Furthermore, the holder 15 is supported by the frame 2 through two arms 18, 19 of a parallel motion mechanism such that the holder 15 can be lifted or lowered by controlling the actuation of an air cylinder device 20 connected to, and provided for moving the arm 18 vertically.

Figure 3:
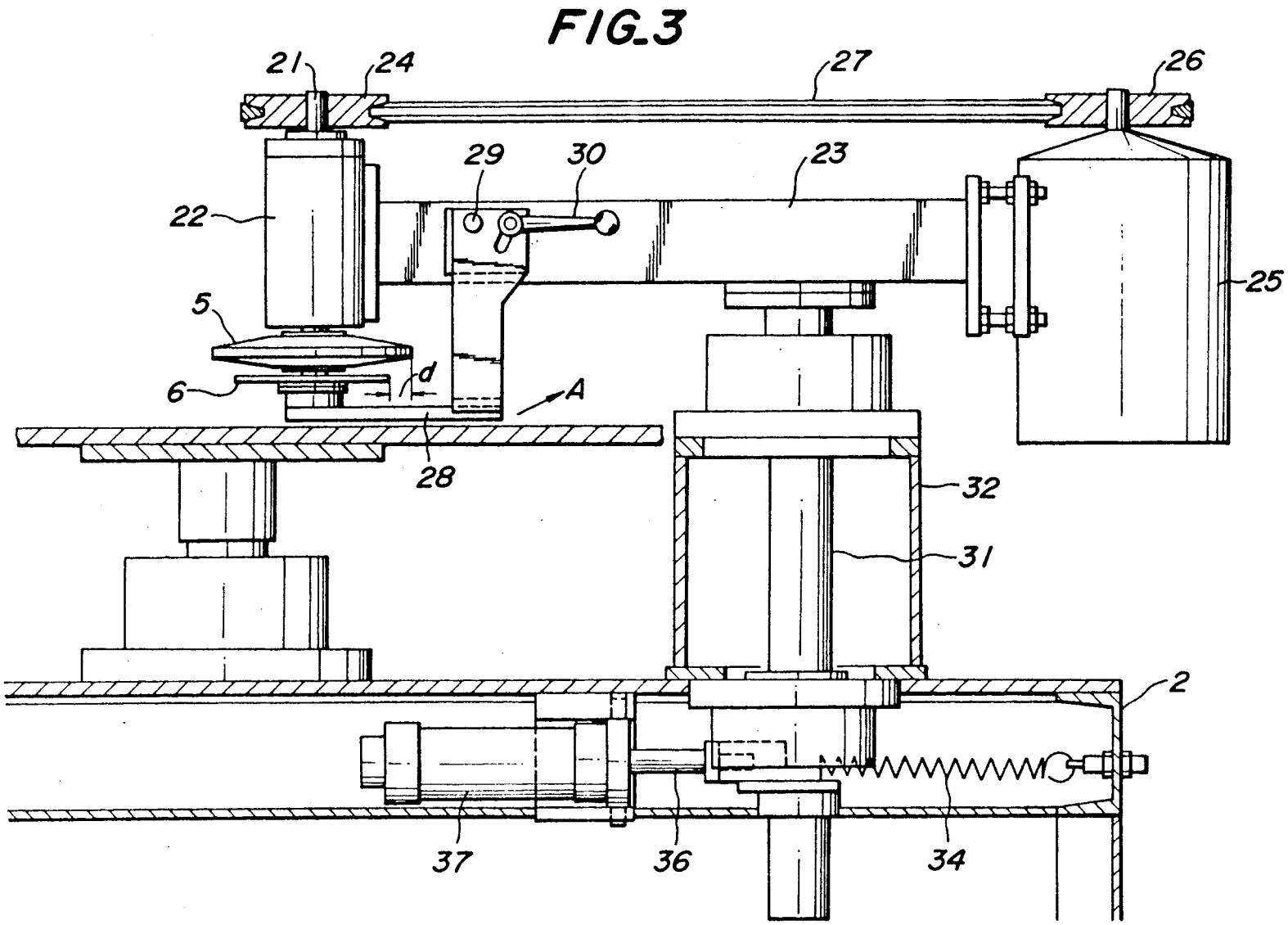
FIG. 3 is a side view, partly in section, of the grinder wheel mechanism therefor.

The grinder wheel 5, as shown in FIG. 3, is secured to the lower end of a vertical shaft 21 rotatably supported by a bearing 22 mounted on the front end of an arm 23. A pully 24 is secured to the upper end of the shaft 21, while a motor 25 is secured to the rear end of the arm 23 and has an output shaft to which is secured a pully 26. A V-belt 27 is arranged between the pullys 24 and 26 so that the rotation of the motor 25 is transmitted to drive the grinder wheel 5. The grinder wheel 5, as shown in FIG. 3, is of disc-like configuration formed by two frustoconical bodies, and has a grinding surface forming an angle with a horizontal plane, which is the chamfering angle of the workpiece W.

The tracer element 6 is arranged below the grinder wheel 5, and has a radius smaller than that of the grinder wheel by a predetermined amount d. The tracer element 6 is rotatably mounted on the upper side of the free end of a bracket 28, coaxially with the grinder wheel 5. The bracket 28 is swingably secured to both sides of the arm 23 by means of a pin 29, and can be fixed thereto when tightened by operating a lever 30. Such an arrangement permits replacement of the grinder wheel 5 by the swinging motion of the bracket 28 in the direction of arrow A in FIG. 3 to displace the tracer element 6. On the other hand, during the chamfering operation to the workpiece W, the bracket 28 assumes a fixed position in which the tracer element 6 is supported horizontally.

Figure 4:
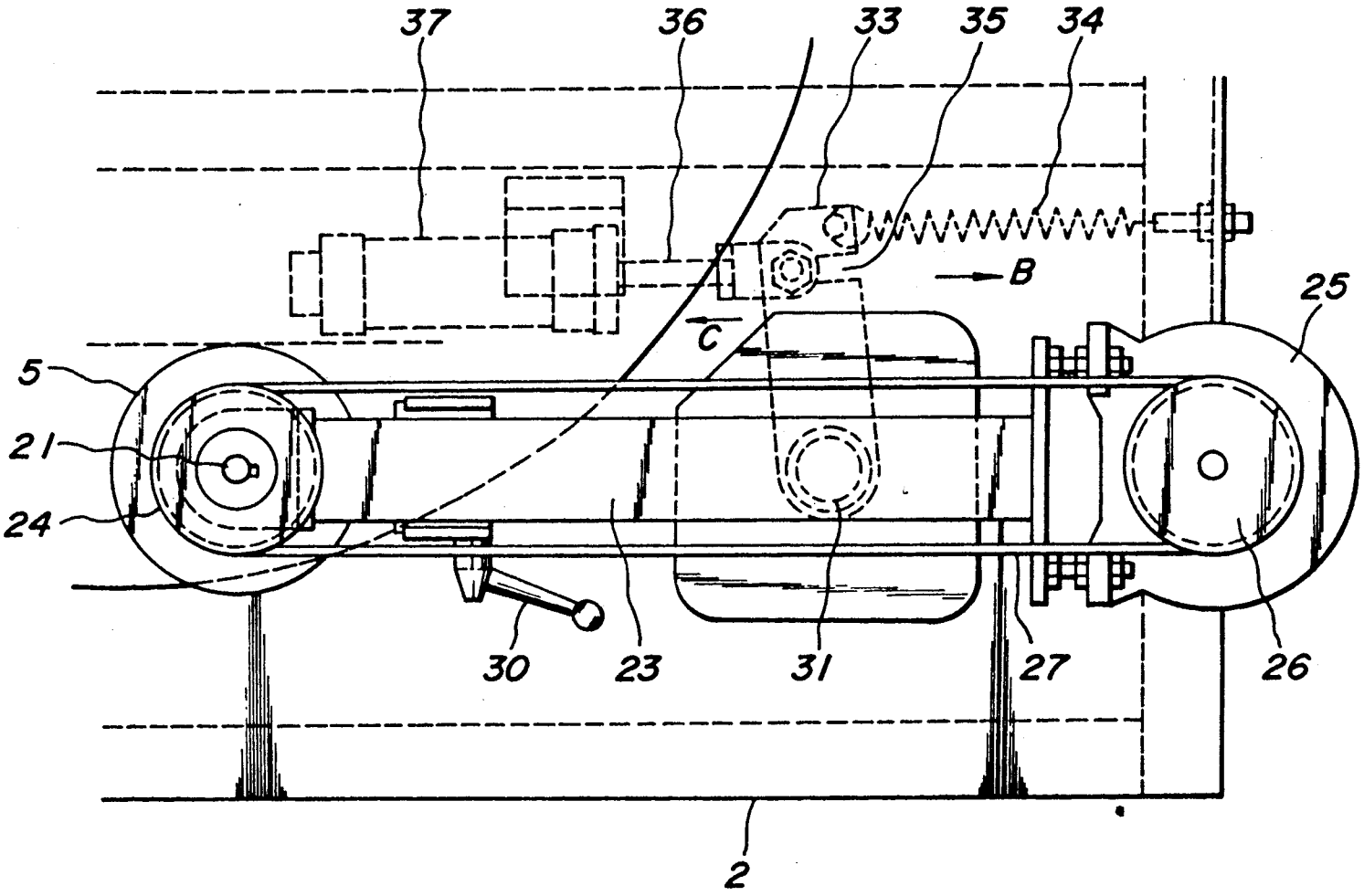
FIG. 4 is a plan view of elements shown in FIG. 3.

The arm 23 is supported by a vertical shaft 31 which is arranged on the frame 2 and rotatably journalled by a bearing 32. As shown in FIG. 4, the lower end of the shaft 31 is fixedly connected to one end of a lever 33. The lever 33 has a free end engaged by a spring 34, one end of which is connected with the frame 2 so as to bias the lever 33 in the direction of arrow B in FIG. 4. The free end of the lever 33 is formed with a slit 35 which is engaged by the end of a plunger rod 36 of an air cylinder device 37. The slit 35 is open on one side only, so that the lever 33 is prevented from rotation in the direction of arrow B in FIG. 4 beyond a position in which the end of the plunger rod 36 abuts against the closed end of the slit 35. In the direction of arrow C, on the other hand, the end of the plunger rod 36 is not prohibited from displacement in the slit 35, so that the lever 33 can be rotated freely.

The chamfering operation with respect to the workpiece W, by means of the above-mentioned arrangement, will now be explained below.

When the turntable 3 rotates and feeds a workpiece W to a location below the upper clamping disc 12, the holder 15 in its lower inoperative position as shown in FIG. 2 is moved upwardly by supplying air to the air cylinder device 20.

Figure 5:
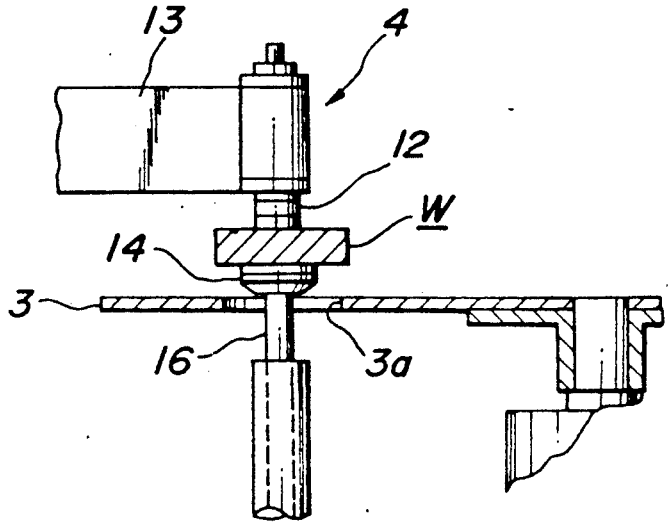
FIG. 5 is a side view showing the clamping device in the operative position thereof.

By this, the lower clamping disc 14 is moved upwardly to lift the workpiece W. As shown in FIG. 5, the turntable 3 with the openings 3*a* permits the above-mentioned lifting motion of the lower clamping disc 14. The workpiece W lifted by the lower clamping disc 14 has its upper surface urged against the upper clamping disc 12, and is clamped between the upper and lower clamping discs 12 and 14.

Subsequently, the motor 17 is actuated to drive the lower clamping disc 14 at a relatively low speed in one direction, causing the workpiece W to rotate.

In this condition, the grinder wheel 5 in its inoperative position as shown by imaginary lines in FIG. 1 is moved by the swinging motion of the arm 23 and urged against the outer periphery on the end surface of the workpiece W.

More particularly, when the air cylinder device 37 is supplied with air, the plunger rod 36 is extended by a predetermined amount in the direction of arrow B in FIG. 4. By this, the force of the spring 34 causes the lever 33 to rotate in the direction of arrow B.

This rotation of the lever 33 results in a swinging motion of the arm 23, so that the grinder wheel 5 and the tracer element 6 are moved along an arcuate path in a direction substantially perpendicular to the outer peripheral surface of the workpiece W in its clamped position as mentioned above.

Because the radius of the tracer element 6 is smaller than that of the grinder wheel 5, in the initial stage, the grinding surface of the grinder wheel 5 is brought into abutment with the outer periphery on one end surface of the workpiece W. At this instance, the end of the plunger rod 36 is not yet in contact with the closed end of the slit 35 formed in the lever 33, so that there still remains a room for the lever 33 to further rotate in the direction of arrow B, accompanying the rotation of the shaft 31.

Accordingly, the grinding operation to the outer periphery on the end surface of the workpiece W is carried out by driving the grinder wheel 5 at a relatively high rotational speed, and by urging the grinder wheel 5 against the outer periphery with a constant pressure which results from the torque of the arm 23 produced by the bias force of the spring 34.

Furthermore, the workpiece W is driven by the clamping device 4 at a relatively low rotational speed, so that the grinding operation of the grinder wheel 5 is carried out gradually, with respect to the entire circumference of the outer periphery on the end surface of the workpiece W. During this operation, since the arm 23 is biased solely by the force of the spring 34, the arm 23 can readily be rotated by a slight counterforce. Thus, as the workpiece W is driven for rotation, the grinder wheel 5 displaces following the irregularity of the configuration of the outer periphery on the end surface of the workpiece W, and is kept urged against the outer periphery with substantially constant pressure.

As the grinding operation to the workpiece W proceeds, the outer periphery of the tracer element 6 arranged below the grinder wheel 5 comes into contact with the outer peripheral surface of the workpiece. At this instance, the grinding depth of the workpiece equals to the difference d in radii of the grinder wheel 5 and the tracer element 6.

Since the tracer element 6 is carried by the arm 23 by means of the bracket 28, the arm 23 is prevented from being rotated beyond the position in which the outer periphery of the tracer element 6 abuts against the outer peripheral surface of the workpiece W.

Thus, eventually, the arm 23 is caused to swing by the tracer element 6 following the outer peripheral contour of the workpiece W (or, an "autoprofiling operation" is carried out), and the entire circumference of the outer periphery on the end surface of the workpiece W is ground with a predetermined constant grinding depth d until completion of the chamfering operation.

Upon completion of the chamfering operation, the air within the air cylinder device 37 is discharged to retract the plunger rod 36 in the direction of arrow C in FIG. 4 and to rotate the lever 33 in the same direction, displacing the arm 23 back into its inoperative position. At the same time, the rotation of the clamping device 4 is terminated and the holder 15 is displaced downwardly into the inoperative position shown in FIG. 1, to release the chamfered workpiece W.

The chamfered workpiece W so released from the clamping device 4 and received by the turntable 3 is removed therefrom, while a new workpiece is supplied to the position below the upper clamping disc 12 to carry out another autoprofiling chamfering operation, by rotating the turntable 3 by a predetermined angle once again.

As explained above in detail, according to the present invention, the outer periphery on the end surface of the workpiece is chamfered by the autoprofiling operation, in which the tracer element in contact with the outer periphery of the workpiece follows the outer contour of the workpiece and controls the swinging motion of the grinder wheel. Thus, an accurate chamfering operation can be carried out by removing, by means of the grinder wheel, a constant amount of material from the outer periphery on the end surface of the workpiece with a constant grinding depth.

Accordingly, the desired accurate chamfering operation can be carried out even when the workpiece has an irregular outer contour, or is inaccurately clamped at a different position. This provides advantages that the adjustment of the machine is not necessary even when the configuration or size of the product is altered, and the workpiece need not be positioned and clamped precisely as a constant amount of material can be accurately removed even when the workpiece is clamped at a different position. Thus, the present invention enables a chamfering operation by using less costly machine to remove an accurate amount of material in short a time, and thus makes it possible to adapt the operation to mass production with an improved yield and uniform product quality.

While the present invention has been explained with respect to certain preferred embodiment, it is apparent that various modifications and alterations may be made without departing from the scope of the present invention. For example, although the tracer element in the illustrated embodiment has been explained as being secured to the arm carrying the grinder wheel, the tracer element may be arranged separately from the grinder wheel such that the tracer element only is brought into contact with the outer periphery of the workpiece in the first place, and then, as the grinding operation proceeds by means of the grinder wheel until a predetermined amount of material is removed, the movement of the grinder wheel with respect to the workpiece is limited by the tracer element to prohibit a further grinding operation. Furthermore, besides the above-mentioned ceramic honeycomb structural body, the present invention may be applied to chamfer workpieces consisting of extruded clay articles or the like, having similar technical problems.

What is claimed is:

1. A machine for chamfering workpieces which have a thinwalled ceramic honeycomb structural body with at least one end surface to be chamfered, comprising:

a machine frame;

a turntable supported by said machine frame so as to be rotatable about a vertical axis and having a horizontal upper surface which supports the workpieces in which a plurality of openings are provided, said turntable being driven intermittently to successively feed the workpieces to a predetermined position;

a clamping device connected to said machine frame and including a pair of vertically opposed discs for clamping each of the workpieces when at the predetermined position, such that there is a substantial radial overhang of each of the workpieces with respect to the discs, vertically deplacing each of the workpieces from said upper surface through the openings, and rotating each of the workpieces in one direction about an axis of rotation of each of the workpieces which extends substantially at a right angle to the end surface of each of the workpieces;

a grinder wheel for chamfering the end surface of each of the workpieces, said grinder wheel being detachably mounted on one end of a rotational shaft which is parallel to said axis of rotation and movable in a direction substantially perpendicular to said axis of rotation;

a tracer element for tracing the outer peripheral contour of each of the workpieces, said tracer element being smaller in radius than said grinder wheel and arranged coaxially therewith during chamfering so as to be movable in a direction substantially perpendicular to said axis of rotation, said tracer element being mounted on a bracket which is movable between an operative position in which said tracer element is located close to, and coaxially with, said grinder wheel and an inoperative position in which said tracer element is located remote from said grinder wheel permitting replacement of at least one of said grinder wheel and said tracer element;

biasing means including a lever loaded by a spring and a fluid cylinder device having a plunger which is connected to said lever, wherein said fluid cylinder moves said lever between an operative position, in which said lever is disengaged from said plunger to permit said spring to resiliently urge said grinder wheel and said tracer element toward each of the workpieces, and an inoperative position, in which said lever is engaged by said plunger to move said grinder wheel and said tracer element away from each of the workpieces; and abutment means for limiting an amount by which said spring resiliently urges said grinder wheel and said tracer element toward each of the workpieces, said abutment means having a slit formed therein in which an end of said plunger is movably engaged, said slit having a least one closed end for preventing said lever from rotating beyond a position in which the end of said plunger abuts against the closed end of said slit;

wherein said grinder wheel and said tracer element are operatively associated with each other such that said tracer element, while tracing the outer peripheral contour of each of the workpieces, controls the movement of said grinder wheel toward and away from said axis of rotation of effect an autoprofiling chamfering of the end surface of each of the workpieces.

2. The chamfering machine of claim 1, further comprising an arm mounted to said shaft to said grinder wheel at one end thereof and a motor for driving said grinder wheel mounted on the other end of said arm, said bracket being mounted therebetween.

* * * * *